US009782652B2

(12) United States Patent
Williamson

(10) Patent No.: US 9,782,652 B2
(45) Date of Patent: Oct. 10, 2017

(54) HEAVY BAG WORKOUT MONITOR SYSTEMS

(71) Applicant: Michael Williamson, Brantwood (CA)

(72) Inventor: Michael Williamson, Brantwood (CA)

( * ) Notice: Subject to any disclaimer, the term of this patent is extended or adjusted under 35 U.S.C. 154(b) by 0 days.

(21) Appl. No.: 14/882,102

(22) Filed: Oct. 13, 2015

(65) Prior Publication Data

US 2016/0059102 A1 Mar. 3, 2016

Related U.S. Application Data

(63) Continuation-in-part of application No. 13/217,491, filed on Aug. 25, 2011, now abandoned.

(51) Int. Cl.

| | |
|---|---|
| ***A63B 69/32*** | (2006.01) |
| ***A63B 71/06*** | (2006.01) |
| ***A63B 24/00*** | (2006.01) |
| ***A63B 69/20*** | (2006.01) |
| ***A63B 69/00*** | (2006.01) |

(52) U.S. Cl.

CPC ..... *A63B 69/32* (2013.01); *A63B 24/0062* (2013.01); *A63B 69/201* (2013.01); *A63B 71/0619* (2013.01); *A63B 71/0686* (2013.01); *A63B 69/004* (2013.01); *A63B 2220/56* (2013.01); *A63B 2220/833* (2013.01); *A63B 2225/20* (2013.01); *A63B 2225/50* (2013.01); *A63B 2225/52* (2013.01)

(58) Field of Classification Search

CPC . A63B 69/32; A63B 71/0686; A63B 71/0619; A63B 69/201; A63B 24/0062; A63B 69/004; A63B 2225/50; A63B 2225/52; A63B 2220/56; A63B 2220/833; A63B 2225/20

See application file for complete search history.

(56) References Cited

U.S. PATENT DOCUMENTS

| | | | |
|---|---|---|---|
| 5,605,336 | A | 2/1997 | Gaoiran et al. |
| 5,803,877 | A | 9/1998 | Franey |
| 5,836,853 | A | 11/1998 | Marciano |
| 6,110,079 | A | 8/2000 | Luedke et al. |
| 7,384,380 | B2 | 6/2008 | Reinbold et al. |
| 7,857,729 | B2 | 12/2010 | Sullivan et al. |
| 7,862,485 | B2 | 1/2011 | Luigi |

(Continued)

*Primary Examiner* — Sundhara Ganesan

(74) *Attorney, Agent, or Firm* — Myron Greenspan; Lackenbach Siegel LLP

(57) ABSTRACT

A heavy bag workout monitor system for receiving and analyzing quantity, location, and magnitude of physical contact and transmitting the information to a user interface, comprising a plurality of impact detection sensors, an impact detector sensor support, and a workout processor for transmitting workout information during a timed period. The heavy bag of the present invention may comprise a first embodiment where the heavy bag measures approximately 5 feet and is ideal for boxers. The boxing bag of this embodiment may comprise a first and second target zone representing an adversary's head and body respectively. A second embodiment may comprise a heavy bag measuring approximately 7 feet comprising a first, second, and third target zone representing an opponent's head, midsection, and legs respectively. The heavy bag workout monitor system may be used to record, track, and monitor workout activity over a period of time and is compatible with a multitude of mobile devices comprising LCD technology.

17 Claims, 10 Drawing Sheets

(56) References Cited

U.S. PATENT DOCUMENTS

| | | | |
|---|---|---|---|
| 7,909,749 | B2 | 3/2011 | Sheedy |
| 8,337,366 | B2 | 12/2012 | Jones et al. |
| 2003/0216228 | A1 | 11/2003 | Rast |
| 2005/0266967 | A1 | 12/2005 | Considine et al. |
| 2005/0288159 | A1 | 12/2005 | Tackett |
| 2006/0252608 | A1 | 11/2006 | Kang et al. |
| 2007/0087911 | A1 | 4/2007 | Ghim |
| 2008/0125293 | A1 | 5/2008 | Ng |
| 2008/0312011 | A1 | 12/2008 | Edmondson |
| 2009/0176632 | A1 | 7/2009 | Wiber |
| 2010/0184010 | A1 | 7/2010 | Perez |

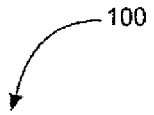
FIG. 2A
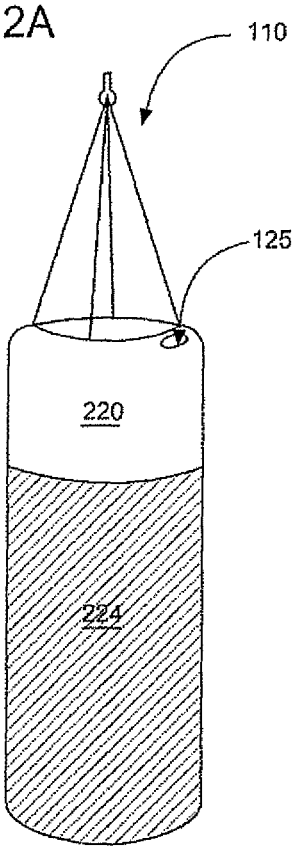
FIG. 2B
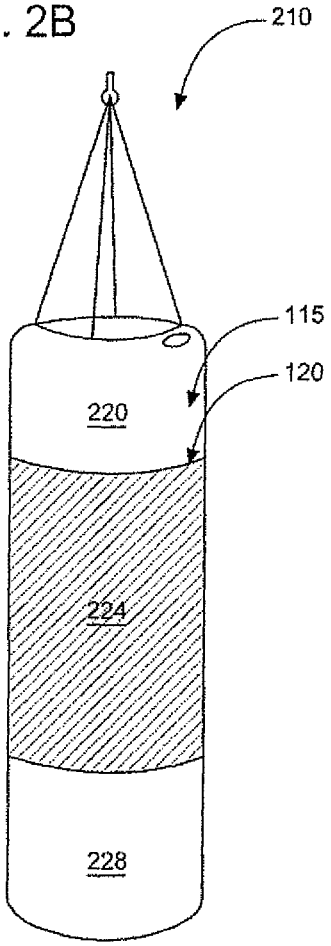

100

110
125
330
350
115
320
335
350
300

210
300
310
320
330
350
115
335
360
365
340

HEAVY BAG WORKOUT MONITOR SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of punching and kicking bags and more specifically relates to a heavy workout bag comprising sensors and a processor for detecting and wirelessly transmitting information pertaining to the quantity, magnitude, and location of the physical blows received from a user during a timed period.

2. Description of the Related Art

Punching and kicking bags serve an important function in exercise and fight training. For example, amateur and professional boxers alike utilize heavy bags for practicing their punching technique. Frequently, a workout for a boxer will include several rounds of sparring with a hanging heavy bag to improve punching ability. The heavy bag will sway in response to the force of the boxer's punches necessitating the boxer to move his feet in rhythm with the motion of the bag.

Furthermore, mixed martial artists may use punching and kicking bags in order to train for upcoming fights. Martial artists may use both their hands and their feet when striking the heavy bag. The durability and resiliency of the heavy bag provides a safe and consistent adversary to endure physical blows of the martial artist.

Boxers and martial artists may want to track the number of kicks and punches that are thrown, as well as the magnitude of force of the kicks and punches. This may be difficult to do manually because athletes may be too focused on achieving proper technique to count and memorize the magnitude and quantity. This may prevent fighters from being able to see tangible evidence of progress or declines in performance. Conventional punching and kicking bags simply provide a workout tool and fail to provide any feedback to the user. The boxer or the martial artist may wish to know how many punches and kicks have been landed in different target areas. Further, it may be desirable to know the magnitude of the force of the physical blows in order to facilitate training and to gauge improvement over a period of time. A more effective solution is needed.

Various attempts have been made to solve the above-mentioned problems such as those found in U.S. Pat. No. 7,909,749 to Sheedy, U.S. Pat. No. 5,605,336 to Gaoiran et al, U.S. Pat. No. 7,384,380 to Reinbold et al, U.S. Pat. No. 5,803,877 to Franey, U.S. Pat. No. 6,110,079 to Luedke et al, U.S. Pat. No. 7,862,485 to Luigi, and U.S. Pat. No. 5,836,853 to Marciano. This prior art is representative of electronic heavy bags. None of the above inventions and patents, taken either singly or in combination, is seen to describe the invention as claimed.

In U.S. Pat. No. 7,857,729 to Sullivan et al an automated striking and blocking trainer is described. However, this trainer is complicated and includes blocking arms to simulate an opponent's blocking blows. The trainer is, therefore, to train a user to hit the bag past the blocking arms and make contact with the sensors that are mounted at or just below the outer surface of the bag. When the bag is hit all accelerometers register an impact. By measuring the recorded intensities at all the accelerometers the accelerometer showing the highest intensity is determined to be located at the point closest to the point of impact. If all the accelerometers show similar acceleration data the trainer discounts such data as being caused by sway or recoil.

Ideally, a heavy bag workout monitor system should require a heavy bag comprising a plurality of impact detection sensors, an impact detector sensor support for analyzing and relaying physical contact received by the heavy bag, and an impact processor for wirelessly communicating the data to a user interface comprising a LCD display, and, yet, would operate reliably and be manufactured at a modest expense. Thus, a need exists for a reliable heavy bag workout monitor system to receive, analyze, and track the physical blows delivered by a user and to avoid the above-mentioned problems.

BRIEF SUMMARY OF THE INVENTION

In view of the foregoing disadvantages inherent in the known electronic heavy bag art, the present invention provides a novel heavy bag workout monitor system. The general purpose of the present invention, which will be described subsequently in greater detail, is to provide a heavy bag comprising a plurality of impact detection sensors, an impact detector sensor support for analyzing and relaying physical contact received by the heavy bag, and an impact processor for wirelessly communicating the data to a user interface.

The present invention may provide a training tool for boxers and martial artists and may track the quantity and magnitude of strikes thrown during a period of time (i.e. round). Heavy bag workout monitor system may comprise two main embodiments, a first embodiment comprising a boxer's punching bag and a second embodiment comprising a mixed martial artist's contact bag. The boxer's punching bag may be sectioned to track head and body strikes, while the martial artist's contact bag may be sectioned to track head, body, and leg strikes. Boxers and martial artists may utilize heavy bag workout monitor systems to chart and evaluate trends and progress during training.

Heavy bag workout monitor systems may generally comprise a plurality of impact detection sensors which may be installed to an impact detector sensor support located within the center of the heavy bag. During use, a boxer or martial artist may activate and strike the bag causing the impact detection sensors to relay strike information to a workout processor unit located atop the heavy bag via a sensor communication cable. The impact detector sensor support may register and analyze the strike and communicate the data to the workout processor unit. The workout processor unit may transmit the quantity and magnitude of the physical blows to a LCD display or a user interface comprising a mobile electronic device (such as a smart phone, tablet, or the like) so that workout information may be displayed to the user. The results may be graphed, tracked, stored within a user profile, and accessed via an internet database.

The various embodiments of heavy bag workout monitor systems for enduring and monitoring physical blows by a user may comprise a heavy bag comprising an outer bag shell having an inner volume. The bag shell may comprise target zones which may be visually distinguishable. The impact detector sensor support may be divided into impact zones which may match the target zones of the bag shell. The heavy bag may comprise a plurality of impact detection sensors which may further comprise acceleration sensors. The impact detection sensors may relay information pertaining to a quantity, location, and magnitude of physical blows that have been received by the heavy bag during a timed period to the workout processor unit.

The heavy bag workout monitor systems may further comprise a processor unit comprising a wireless communication interface. The workout processor unit may comprise a wireless communication signal with a user interface. The workout processor unit may further comprise at least one power supplier comprising battery pack having a DC power source. The workout processor unit may serve to analyze, store, and track workout information relating to the quantity, location, and magnitude of the physical blows delivered by the user during a data collection period.

The present invention holds significant improvements and serves as a heavy bag workout monitor system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, heavy bag workout monitor system, constructed and operative according to the teachings of the present invention.

FIGS. 2A & 2B show a perspective exterior view illustrating the heavy bag workout monitor system comprising a boxer's punching bag and a martial artist's punching and kicking bag respectively according to an embodiment of the present invention of FIG. 1.

The various embodiments of the present invention will hereinafter be described in conjunction with the appended drawings, wherein like designations denote like elements.

DETAILED DESCRIPTION

Figure 1:
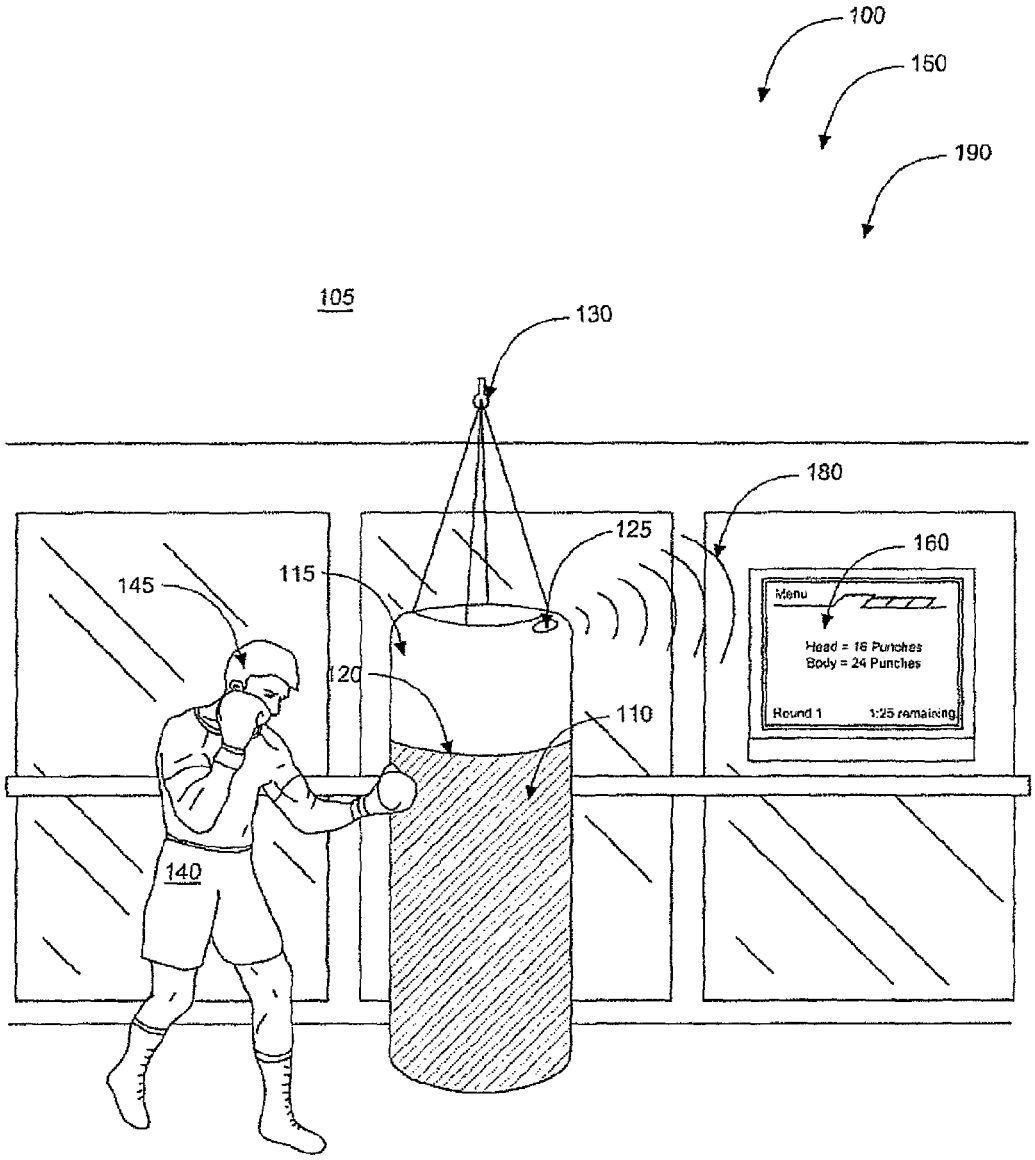
FIG. 1 is a perspective view illustrating a heavy bag workout monitor system in an 'in use' condition in wireless communication with a LCD display according to an embodiment of the present invention.

As discussed above, embodiments of the present invention relate to a heavy bag workout device and more particularly to heavy bag workout monitor systems 100 as used to improve the ability to track and monitor progress for fighters.

In a first embodiment of the present invention, heavy bag workout monitor systems 100 may comprise boxer's punching bag 110 for enduring, monitoring, and analyzing physical blows by boxer 145. Boxer's punching bag 110 of heavy bag workout monitor systems 100 may comprise bag shell 115 having inner volume. Bag shell 115 may further comprise first target zone 220, and second target zone 224, wherein first target zone 220 and second target zone 224 is bifurcated. First target zone 220 and second target zone 224 may be of different colors or shades, thereby visually distinguishing first target zone 220 from second target zone 224.

Heavy weight workout monitor systems 100 may further comprise impact detector sensor support 300 having first impact zone 330 and second impact zone 335, wherein first impact zone 330 represents an opponent's head, and second impact zone 335 represents the opponent's body. Preferably, first impact zone 330 corresponds to first target zone 220, and second impact zone 335 corresponds to second target zone 224. Impact detector sensor support 300 comprises impact detector sensor support cover 310 comprising a protective enclosure within bag shell 115. In addition, heavy bag workout monitor systems 100 may comprise plurality of impact detection sensors 350. Impact detection sensors 350 may comprise acceleration sensors, wherein impact detection sensors 350 relay information pertaining to a quantity and a magnitude of physical blows to impact detector sensor support 300, and wherein impact detection sensors 350 are capable of compensating for motion of heavy bag workout monitor systems 100 resulting from physical blows by user 140 when analyzing the magnitude of the punches.

In now referring to the drawings by numerals of reference there is shown in FIG. 1, heavy bag workout monitor systems 100 during 'in use' condition according to one embodiment of the present invention. As shown, heavy bag workout monitor systems 100 may comprise boxer's punching bag 110 which may absorb and analyze contact delivered by user 140. User 140 may comprise boxer 145 who may be punching boxer's punching bag 110 in gym 190. Boxer's punching bag 110 may be installed via heavy bag installation assembly 130 to structural member 105 wherein structural member 105 may comprise ceiling of gym 190.

In continuing to refer to FIG. 1, exterior of boxer's punching bag 110 may generally comprise bag shell 115 wherein bag shell 115 may comprise bag shell contact zone divider 120 for separating designated target zones representing different parts of an opponent's body. As shown in FIG. 1, bag shell contact zone divider 120 of boxer's punching bag 110 provides a bifurcated bag shell 115 preferably separating a head region and a body region. Furthermore, each section may be visually distinguished by color for further enhancing the separation between target zones.

In still to referring to FIG. 1, heavy bag workout monitor systems 100 may comprise workout processor unit 125. Workout processor unit 125 may comprise a computer processor for transmitting wireless communication signal 180 to LCD display 160. As will be discussed in greater detail, heavy bag workout monitor systems 100 may analyze quantity and magnitude of punches received by boxer's punching bag 110 delivered by user 140 comprising boxer 145. This information may be transmitted via wireless communication signal 180 to be displayed on LCD display 160.

In referring now to FIG. 2, illustrating an exterior perspective view of two preferred embodiments of heavy bag workout monitor systems 100. As shown, FIG. 2A depicts boxer's punching bag according to an embodiment of the present invention of FIG. 1. Boxer's punching bag may measure approximately 5' feet in length and may be bifurcated to distinguish first target zone 220 from second target zone 224. First target zone 220 may represent an opponent's head region and second target zone 224 may represent an opponent's body region. Furthermore, workout processor unit 125 may be located at the top of boxer's punching bag 110 for transmitting workout information via wireless communication signal 180.

In referring now to FIG. 2B, illustrating martial artist's contact bag 210. As shown, martial artist's contact bag 210 may be trifurcated thereby separating first target zone 220, second target zone 224, and third target zone 228. First target zone 220 may represent an opponent's head region, second target zone 224 may represent an opponent's body or midsection region, and third target zone 228 may represent an opponent's leg region. Martial artist's contact bag 210 may comprise a length of approximately 7'. Furthermore, first target zone 220, second target zone 224, third target zone 228 may comprise different colors and designs thereby visually distinguishing the different target sections.

It should be appreciated that heavy bag workout monitor systems 100 may be manufactured in a variety of sizes to accommodate user 145 desiring to practice alternative fighting styles. Furthermore, first target zone 220, second target zone 224, and third target zone 228 may comprise different lengths for accommodating various fighting styles. In addition, first target zone 220, second target zone 224, and third target zone 228 may comprise a variety of colors and designs.

Figures 3A, 3B:
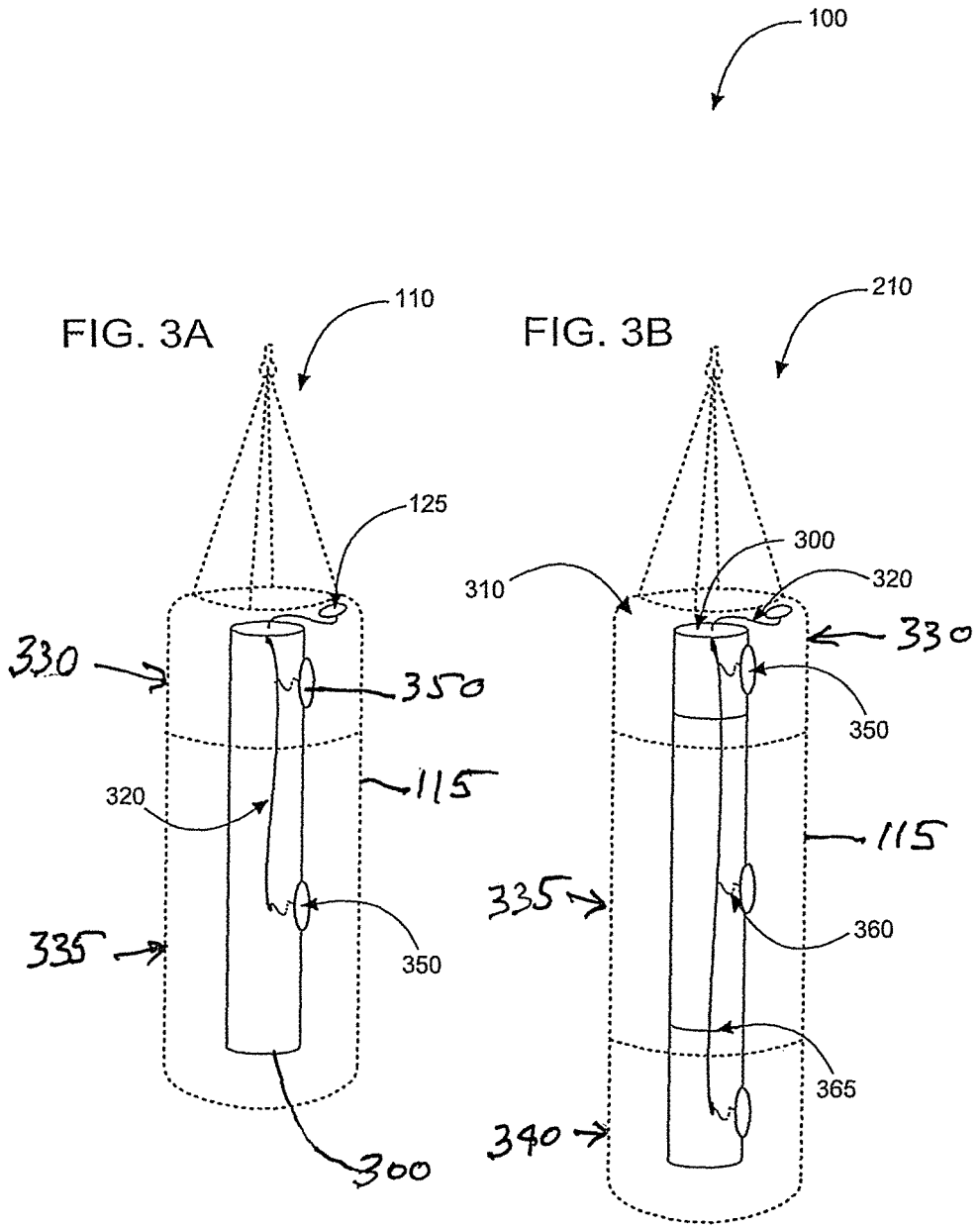
FIGS. 3A & 3B show a perspective interior view illustrating the boxer's punching bag and the martial artist's punching according to an embodiment of the present invention of FIG. 1.

In referring now to FIGS. 3A and 3B, illustrating an interior perspective view of heavy bag workout monitor systems 100 according to an embodiment of the present invention of FIGS. 2A and 2B. As shown, FIG. 3A depicts boxer's punching bag 110 internally comprising impact detector sensor support 300 which may be enclosed within impact detector sensor support cover 310. Further, impact detector sensor support cover 310 may be surrounded by impact resilient stuffing. Impact detection sensor 350 may be attached to impact detector sensor support 300 and connected to workout processor unit 125 via sensor communication cable 360. As shown, a plurality of impact detection sensors 350 may be located within bag shell 115 protruding outwardly from impact detector sensor support 300. Impact detection sensor 350 may be designed and optimized to detect and sense impact received by heavy bag workout monitor systems 100. Preferably, impact detection sensors 350 may be evenly distributed throughout heavy bag workout monitor systems 100 along or within the impact detector sensor support 300.

In continuing to refer to FIG. 3A, impact detector sensor support 300 of boxer's punching bag 110 may be divided into two impact zones. More specifically, impact detector sensor support 300 of boxer's punching bag 110 may comprise first impact zone 330 and second impact zone 335. During 'in use' condition 150, impact detection sensor 350 of first impact zone 330 may detect punches delivered to the opponent's head region and impact detection sensor 350 of second impact zone 335 may detect punches delivered to the opponent's body region. Preferably, first impact zone 330 and second impact zone 335 is lined up evenly with first target zone 220 and second target zone 224 of bag shell 115 of boxer's punching bag 110 as seen in FIG. 2A.

In referring now to FIG. 3B, depicting an interior perspective view of martial artist contact bag 210. As shown, impact detector sensor support 300 of this embodiment may be trifurcated comprising first impact zone 330, second impact zone 335, and third impact zone 340. During 'in use' condition 150, impact detection sensor 350 of first impact zone 330 may detect physical blows delivered to the opponent's head region, impact detection sensor 350 of second impact zone 335 may detect physical blows delivered to the opponent's body or mid-section region, and impact detection sensor 350 of third impact zone 340 may detect physical blows delivered to the leg region. It should be noted that physical blows may comprise either punches or kicks. Preferably, first impact zone 330, second impact zone 335, and third impact zone 340 are lined up evenly with first target zone 220, second target zone 224, and third target zone 228 of bag shell 115 of martial artist contact bag 210 as depicted in FIG. 3A.

In still referring to FIGS. 3A and 3B of heavy bag workout monitor systems 100, workout processor unit 125 may be connected to impact detector sensor support 300 via connector 320, wherein connector 320 comprises a cable connection for relaying information from impact detection sensor 350 to workout processor unit 125.

Figure 4:
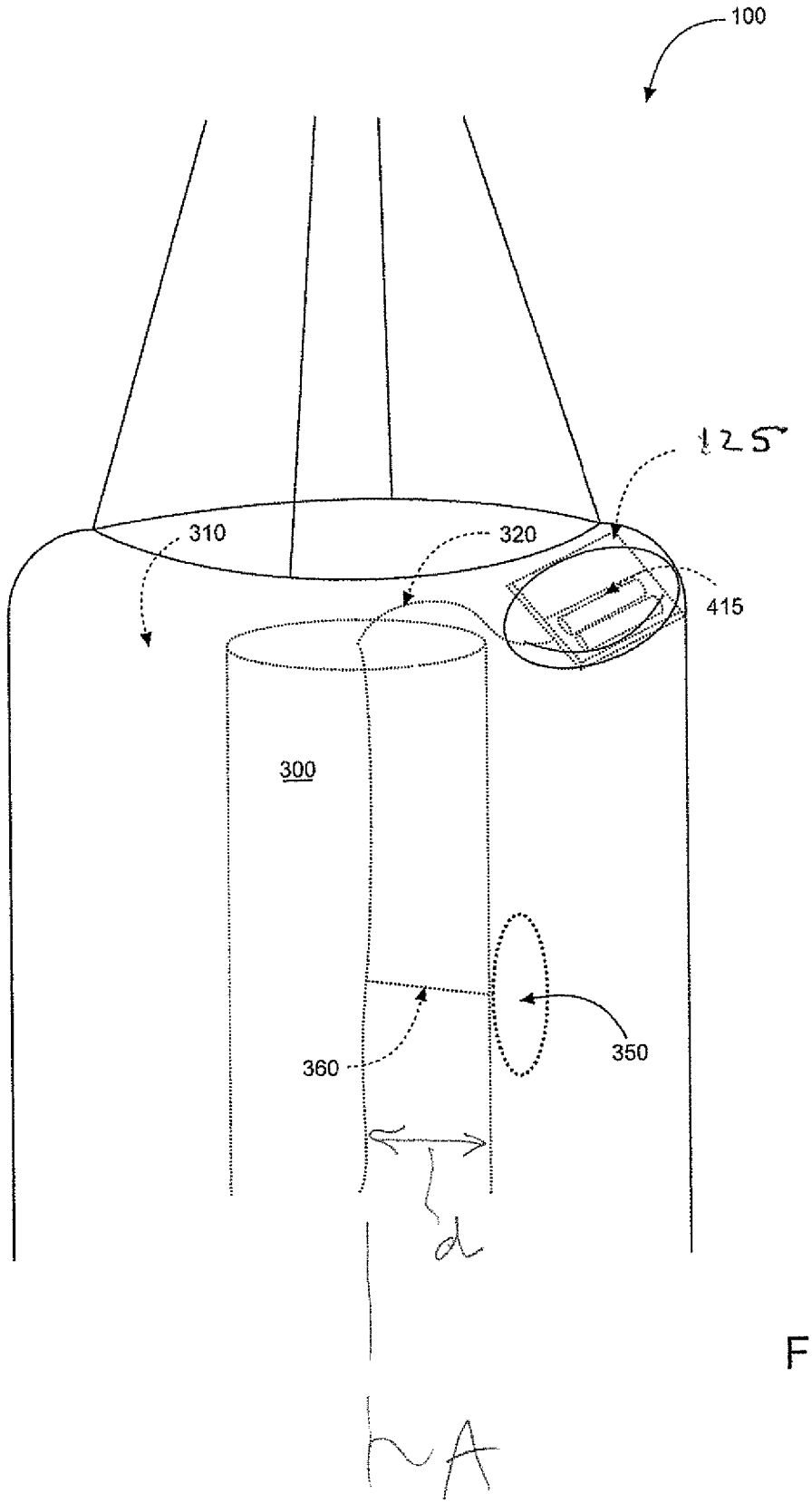
FIG. 4 is a close-up perspective view illustrating a workout processor unit according to an embodiment of the present invention of FIG. 1.

Referring now to FIG. 4, illustrating a close-up perspective view of workout processor unit 125 of heavy bag workout monitor systems 100. As shown, workout processor unit 125 may comprise a power supply which may comprise a battery pack 415. Battery pack 415 may comprise a set of AA batteries for providing power to workout processor unit 125. In such a manner, heavy bag workout monitor systems 100 does not require the use of wires or cables to supply power which may be dangerous or unsightly during 'in-use' condition 150. However, workout processor unit 125 may be powered by a direct cable connection. Furthermore, workout processor unit 125 may be attached to a top portion of heavy bag workout monitor systems 100 via workout processor connection means 425. In one embodiment, workout processor connection means 425 may comprise Velcro for attachment to the heavy bag workout monitor systems 100. However, alternative attachment methods may be utilized.

Figure 5:
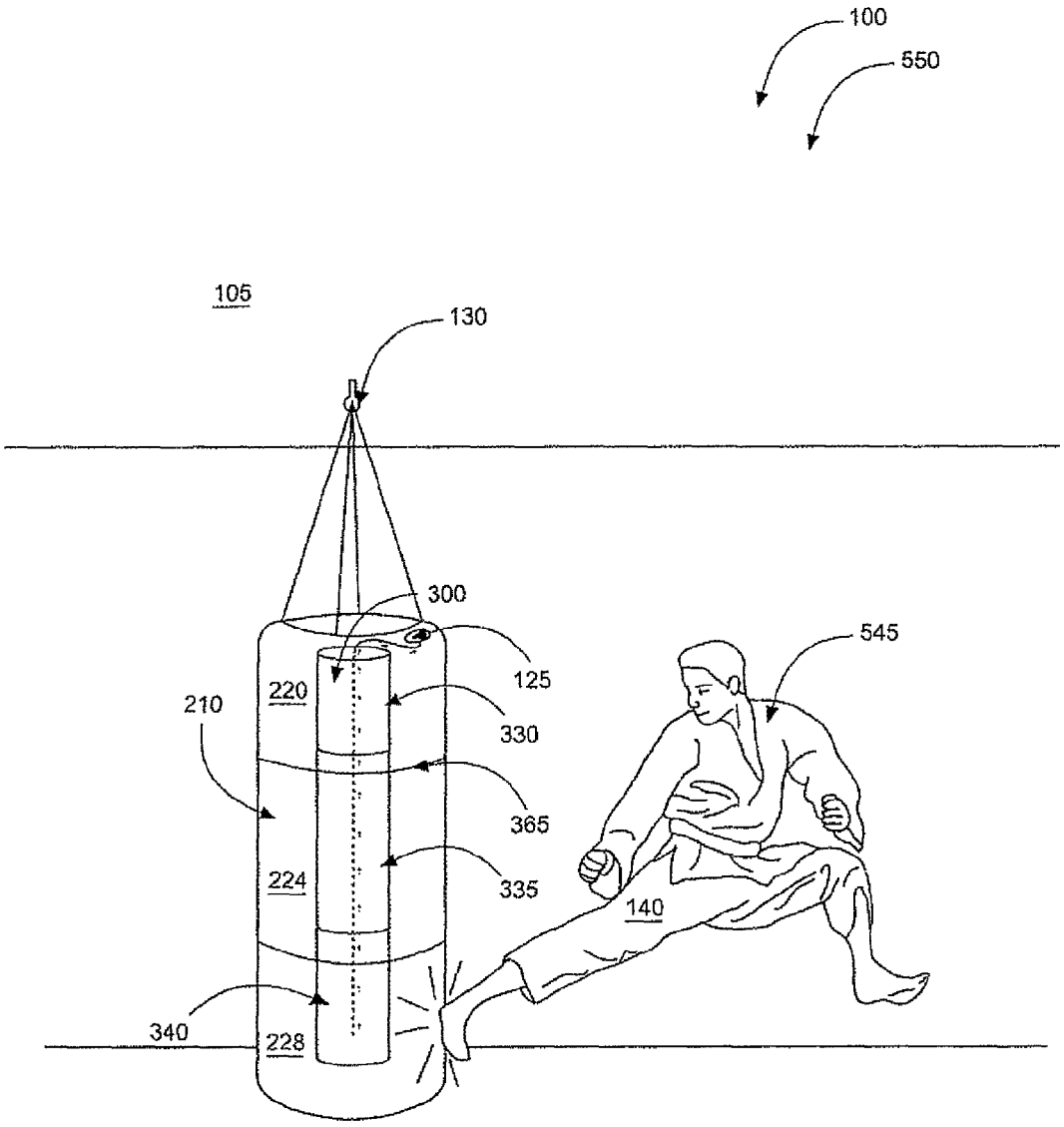
FIG. 5 is a perspective view illustrating the martial artist's punching and kicking bag in an 'in use' condition according to an embodiment of the present invention of FIG. 1.

In referring now to FIG. 5, illustrating heavy bag workout monitor systems 100 during 'in-use' condition 550 according to an embodiment of the present invention of FIGS. 2B and 3B. As shown, user 140 comprising martial artist 545 may use martial artist contact bag 210 for analyzing and tracking punches and kicks delivered to first target zone 220, second target zone 224, and third target zone 228. Martial artist contact bag 210 may be installed to structural member 105 via heavy bag installation assembly 130. Impact detector sensor support 300 of martial artist contact bag 210 may be trifurcated into three contact regions which may line up to the three target zones of bag shell 105. Impact zones may be divided via impact zone divider 365 as shown.

In continuing to refer to FIG. 5, a kick delivered by user 140 comprising martial artist 545 may be registered by impact detection sensor 350 located within third target zone 228 of martial artist contact bag 210. The kick may be communicated from impact detection sensor 350 to workout processor unit 125 where the force of the contact may be analyzed.

Figure 4A:
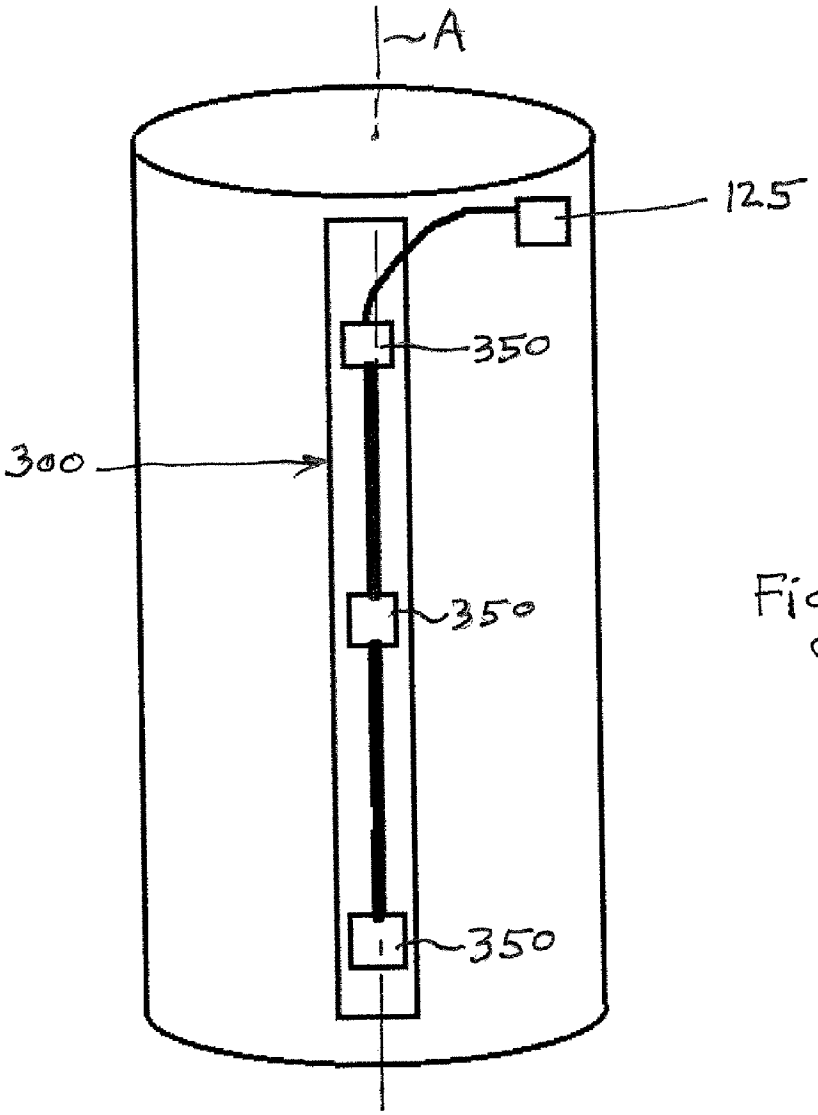
FIG. 4A is a diagrammatic representation of the punching bag shown in FIGS. 1-3B, showing the preferred locations of the sensors along or proximate to the vertical axis of the punching bag.

An important feature of the invention is the placement of the sensors or accelerometers 350 at or within the core 300 and removed from the bag shell 115. Referring to FIG. 4, the sensors are preferably placed along the axis A of the bag. However, the sensors may be offset slightly from the axis A by a distance "d" as long as the sensors are not at or near the surface of the shell. Preferably "d" is up to 15% of the bag diameter. Thus, for example, on a 15" diameter bag d can be a maximum of 1.5". By locating the sensors at or near the axis A at or within the support 300 (see FIG. 4A), the sensors can be responsive to the linear swings, movements or motions while substantially eliminating the effects of direct blows and rotations of the bag about its axis A. Since direct blows will convert the kinetic energy to swings or deflections the angular motions or movements of the bag in the directions of the impact will be converted to information reflecting the magnitude of the impact. Clearly, the greater the impact force the greater will be the movements or swings of the bag and this will be translated to impact forces. Once the bag reacts to an impact and the bag is set into motion all the sensors will detect the swinging motions and can be calibrated to reflect the distances that the sensors are from the point at which the bag is hung or pivots from. In this way any of the sensors can provide the same or similar information regarding the force of an impact of a strike based on the movements of the bag in the direction of impact.

It should be noted that workout processor unit 125 of heavy bag workout monitor systems 100 is designed to the swinging motion of the heavy bag and convert the swing to the actual magnitude of the strike received. In such a manner, user 140 will receive reliable and accurate information pertaining to the exact force of the strike. This data may be transferred from impact detection sensor 350 to workout processor unit 125 via sensor communication cable 360. Workout processor unit 125 may then wirelessly transmit workout information utilizing Bluetooth technology via wireless communication signal 180.

Figure 6:
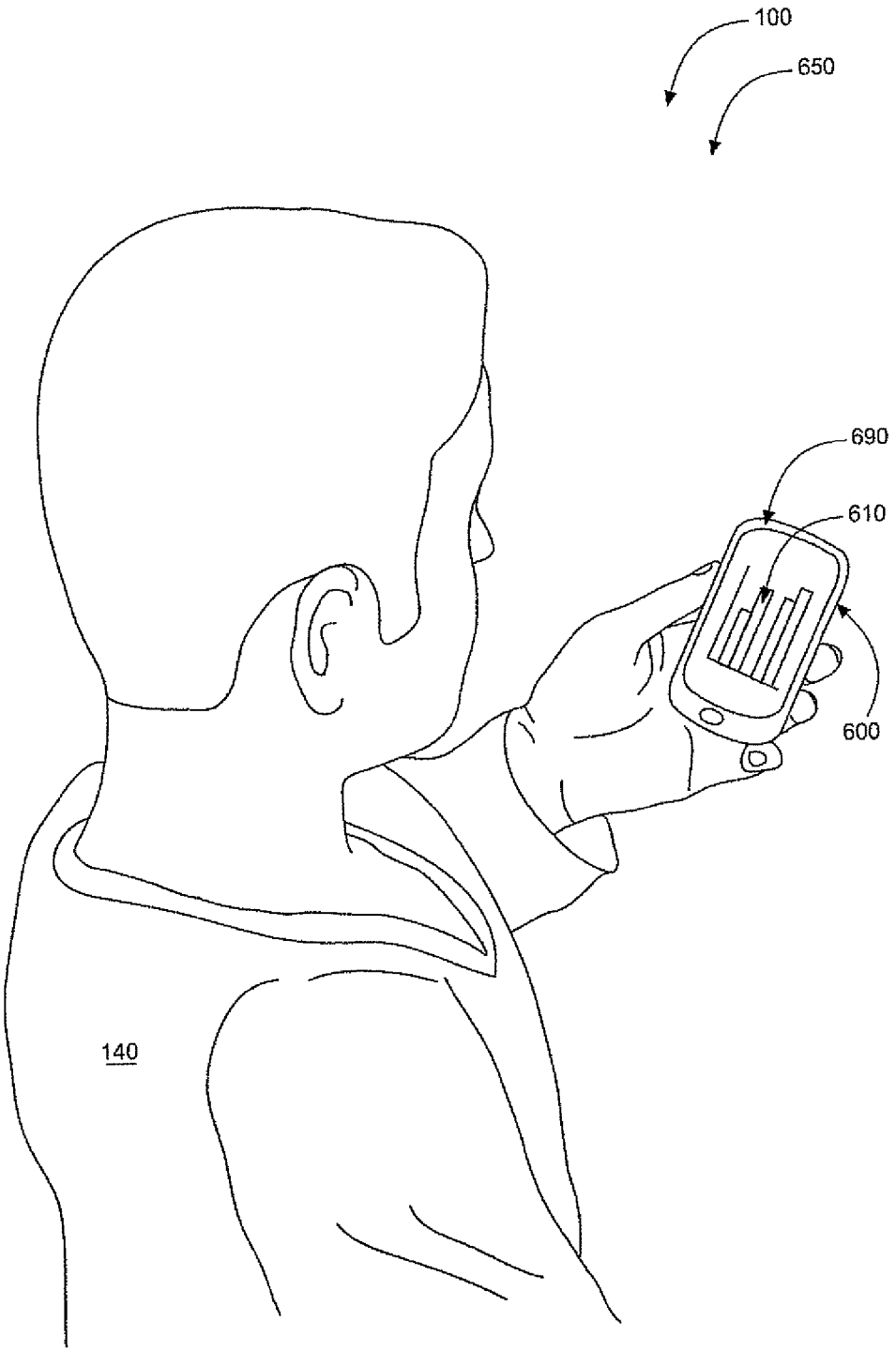
FIG. 6 is a perspective view illustrating a user accessing workout statistics utilizing a user interface comprising a smart phone according to an embodiment of the present invention of FIG. 1.

In referring now to FIG. 6, illustrating a perspective view of heavy bag workout monitor systems during 'in-use' condition 650 according to an embodiment of the present invention. As shown, user 140 may view workout results via user interface 600 wherein user interface 600 may comprise smart phone 690. Smart phone 690 may comprise iPhone, Android, Blackberry, or other mobile communication device comprising a Bluetooth connection. In such a manner, heavy bag workout monitor systems 100 may be linked to user interface 600 for wirelessly transmitting workout data. As shown in FIG. 6, user 140 may view personal results via performance chart 610. Performance chart 610 may generally comprise a graph or other visual depiction which may identify the quantity and force of strikes delivered to the different target zones of heavy bag workout monitor systems 100. User interface 600 may comprise LCD display 160, smart phone 690, tablet 692, or computer 694.

In still referring to FIG. 6, it should be appreciated that user 140 comprising boxer 145 training with boxer's punching bag 110 may receive information regarding the quantity of punches and magnitude of punches delivered to first target zone 220 and second target zone 224. In such a manner, boxer 145 may track information relating to the amount of punches and the force of punches delivered to an opponent's head and body section during a timed period.

In continuing to refer to FIG. 6, it should be further be noted that user 140 comprising martial artist 545 training with boxer's martial artist contact bag 210 may receive information via user interface 600 regarding the quantity of punches and kicks and magnitude of punches and kicks delivered to first target zone 220, second target zone 224, and third target zone 228. In such a manner, martial artist 545 may track information relating to the amount of punches and kicks and the force of punches and kicks delivered to an opponent's head, body, and leg section during a timed period.

Heavy bag workout monitor systems 100 may comprise martial artist contact bag 210 for enduring and monitoring physical blows by martial artist 545. This embodiment may comprise martial artist contact bag 210 comprising bag shell 115 having inner volume, wherein bag shell 115 may comprise first target zone 220, second target zone 224, and third target zone 228. First target zone 220, second target zone 224, and third target zone 228 may be trifurcated, and each zone may be a different color, thereby visually distinguishing first target zone 220, second target zone 224, and third target zone 228.

Figure 7:
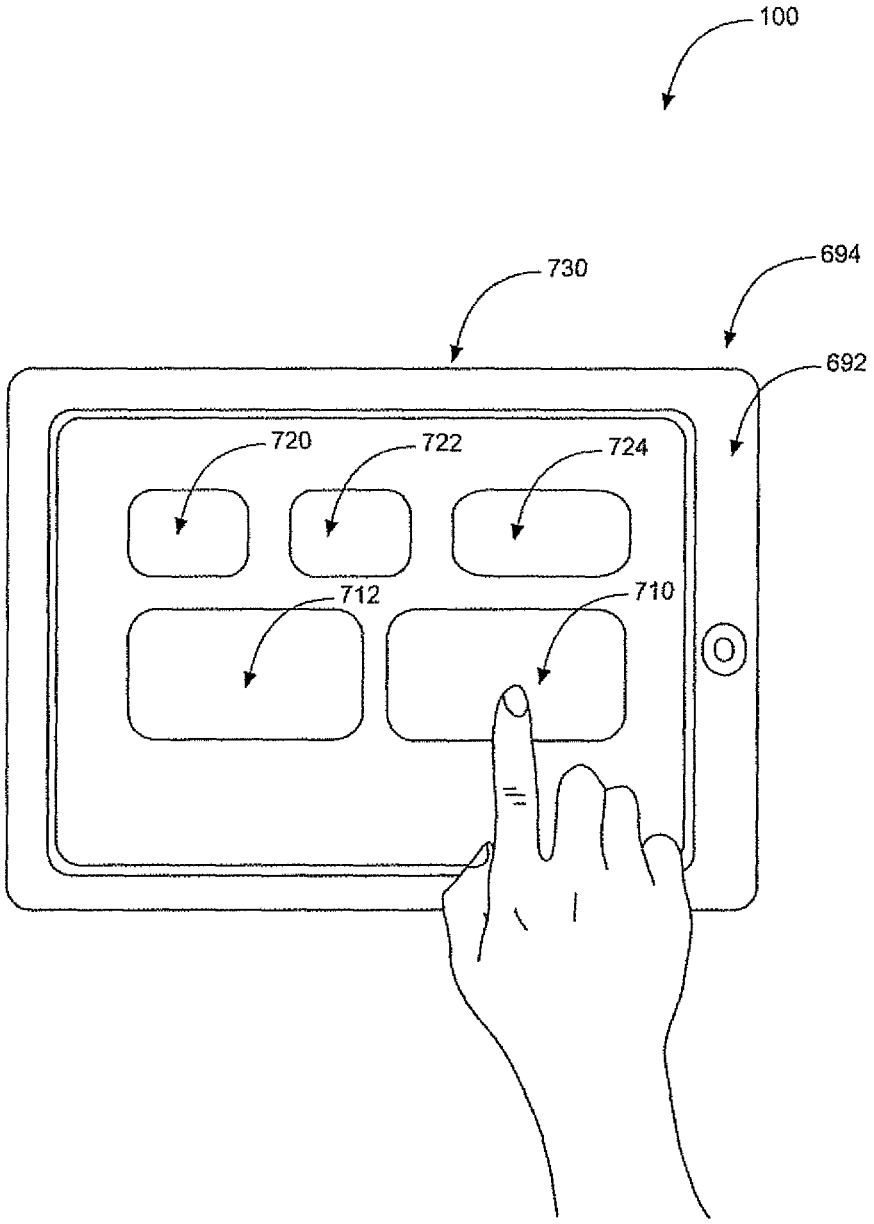
FIG. 7 is a perspective view illustrating a plurality of menu options for configuring the heavy bag workout monitor system according to an embodiment of the present invention of FIG. 1.

FIG. 7 shows a perspective view of user interface 600 comprising tablet 692 having a plurality of menu options for configuring settings of heavy bag workout monitor systems 100. In one embodiment of the present invention, menu options may comprise start control 710, stop control 712, reset button 720, link button 722, and view results button 724. As best seen in FIG. 7, user 140 may select a menu button via user interface 600 comprising a touch screen LCD display in order to optimally configure settings of heavy bag workout monitor systems 100.

In still referring to FIG. 7, button comprising start control 710 may be used for activating heavy bag workout monitor systems 100. Alternatively, heavy bag workout monitor systems 100 may be activated upon initial contact. In such a manner, heavy bag workout monitor systems 100 may enter a sleep state when not used for a period of time and may awake from the sleep state upon physical contact. Button comprising stop control 712 may be used to stop heavy bag workout monitor systems 100 in the middle of a timed period. Stop control 712 may further be used to pause workout temporarily. In such a fashion, user 140 may continue workout by pressing start control 710. Reset button 720 may be used to return heavy bag workout monitor systems 100 to a default state. This may be utilized when user 140 wishes to reset workout information and begin a new round. Link button 722 may be utilized when user 140 desires to sync workout processor unit 125 to user interface 600 via wireless communication interface comprising Bluetooth technology. When link button 722 is pressed, workout processor unit 125 may automatically attempt to locate a compatible device in order to create a secure wireless connection. Once a connection has been established, link button 722 may be pressed to break the wireless connection. View results button 724 may provide user 140 with a means for viewing workout results from a recent workout period. Upon pressing view results button 724, information may appear on user interface 600 pertaining to the quantity of strikes received by heavy bag workout monitor systems 100 as well as the highest and average magnitude of strikes delivered. The information may be displayed overall and based on target section. In such a manner, user 140 may receive specific work out details which may aid in training purposes.

In a method of using heavy bag workout monitor systems 100, user 140 may configure the settings of the menu via user interface 600 or via LCD display 160. User 140 may configure the amount of rounds and the time in each round. In such a manner, user 140 may customize his or her workout and training accordingly.

Although not illustrated in the accompanying figures, Heavy bag workout monitor systems 100 may comprise a speaker for emitting a buzzer sound. The buzzer sound of heavy bag workout monitor systems 100 may provide an alert to signify the beginning and end of a round, as well as provide an indication when 10 seconds are remaining in a round. The buzzer may sound for 3 seconds at each interval. In such a manner, user 140 will know when impact detection sensors 350 are active and inactive and when to begin winding down a workout. This is similar to the warning professional fighters receive when a round is about to end. It should be appreciated that the buzzer sound produced by heavy bag workout monitor systems 100 may provide a more interactive and complete workout experience.

In referring to the different embodiments of heavy bag workout monitor systems 100, demonstration mode 730 may be provided. In a preferred embodiment, demonstration mode 730 may comprise one round and one workout limited to 10 seconds. In other embodiments, demonstration mode 730 may be shorter or longer. Demonstration mode 730 is ideal for exposing a new user 140 to heavy bag workout monitor systems 100.

Figure 8:
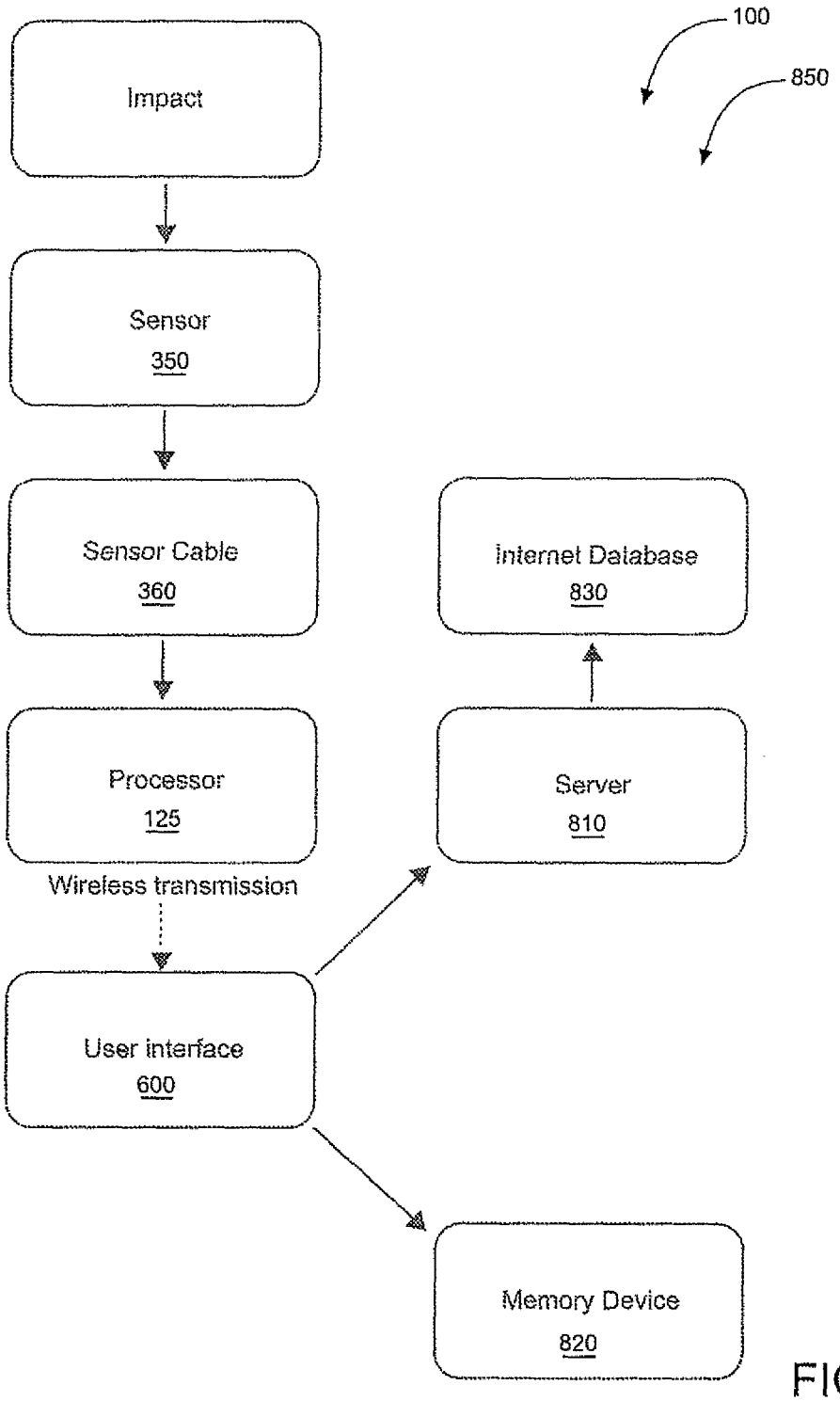
FIG. 8 is a perspective view illustrating a flowchart showing a communication of data of the heavy bag workout monitor system according to an embodiment of the present invention of FIG. 1.

In referring now to FIG. 8, illustrating data flowchart 850 of heavy bag workout monitor systems 100 according to the embodiments of the present invention of FIGS. 1-7. As shown, during 'in-use' condition 150 of heavy bag workout monitor systems 100, data may be initially received upon an impact by user 140. Data pertaining to the strike may be detected by impact detection sensors 350 and the information may then be relayed from impact detection sensors 350 to workout processor unit 125 via sensor communication cable 360. Workout processor unit 125 may then track the quantity of strikes received to the different target regions of bag shell 115. As shown in FIG. 8, workout processor unit 125 may collect data from impact detection sensors 350 relevant to a workout period and may wirelessly transmit the information to user interface 600. In one embodiment, user interface 600 may comprise LCD display 160. In alternative embodiments, user interface 600 may comprise smart phone 690, tablet 692, computer 694, and the like.

In continuing to refer to FIG. 8, once data is transmitted from workout processor unit 125 to user interface 600, the workout information may be displayed to user 140 on display screen. Further, workout information may be transferred directly or wirelessly from user interface 600 to memory device 820. It should be noted that memory device 820 may comprise a memory card or memory stick, and may be transferred via a USB cable or the like.

In still to referring to FIG. 8, workout information may be transferred from user interface 600 to internet database 830. Internet database 830 may comprise a large online database that may store a plurality of user profiles. User 140 may keep track of workout statistics over a large period of time via the user profile and may access the user profile via internet database 830. In such a manner, user 140 may view workout results on the internet from virtually any location where internet is accessible. Internet database 830 may be particularly useful for websites that wish to provide an organized method for user 140 to securely log in and monitor his or her workout results.

Figure 9:
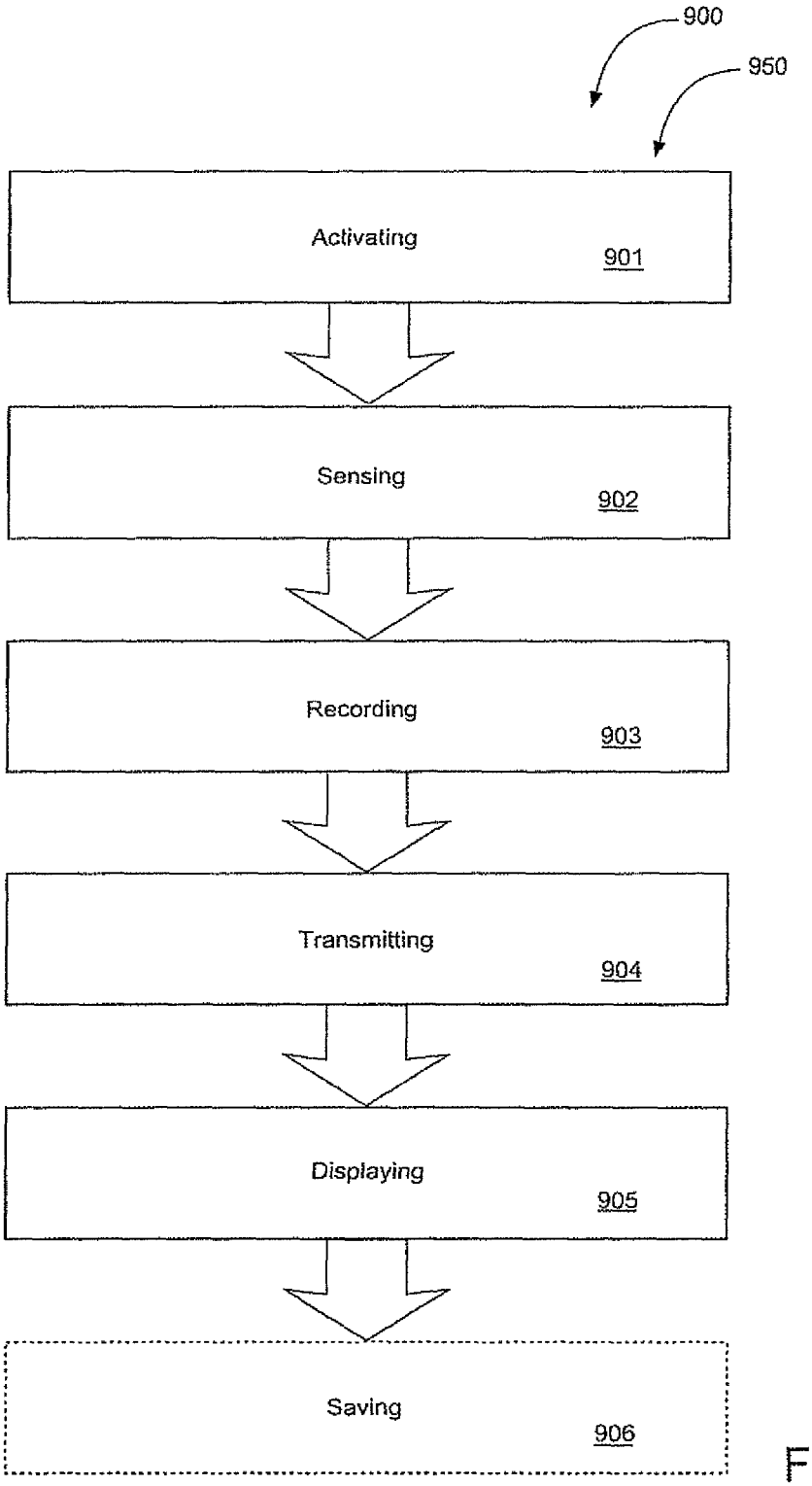
FIG. 9 is a flowchart illustrating a method of use according to an embodiment of the present invention of FIGS. 1-9.

FIG. 9 shows flowchart 950 illustrating method of use 900 of heavy bag workout monitor systems 100 according to a preferred embodiment of the present invention of FIGS. 1-8. Method of use 900 may comprise the steps of: step one 901 activating heavy bag workout monitor system 100, step two 902 sensing physical blows by user 140 via impact detection sensors 350, step three 903 recording physical blows, step four 904 transmitting workout information regarding physical blows to user interface 600, step live 905 displaying workout information on user interface 600, and step six 906 saving workout information on memory device 820.

It should be noted that step six 906 is an optional step and may not be implemented in all covers. Optional steps of method 900 of heavy bag workout monitor systems 100 are illustrated using dotted lines in FIG. 9 so as to distinguish them from the other steps of method 900.

Heavy bag workout monitor systems 100 may comprise the following parts: at least one heavy bag comprising boxers punching bag 110 or martial artist contact bag 210; at least one bag shell 115; at least one workout processor unit 125; at least one heavy bag installation assembly 130 for hanging heavy bag from structural member 105; at least one impact detector sensor support 300; at least one impact detector sensor support cover 310 for securably retaining impact detector sensor support 300; at least one connector 320 for connecting impact detector sensor support 300 to workout processor unit 125; at least one power supplier comprising battery pack 415; at least one workout processor attacher 425 for attaching workout processor unit 125 to heavy bag; and at least one set of user instructions.

Heavy bag workout monitor systems 100 may be manufactured and provided for sale in a wide variety of sizes and shapes for a wide assortment of applications. It should be noted that in an embodiment of the present invention, heavy bag workout monitor systems 100 may be sold with LCD display 160. This may be ideal for fitness centers and gyms where heavy bag workout monitor systems 100 may be used by a number of fighters. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A heavy bag workout monitor system for analyzing the extent of physical blows by a user following a workout session comprising:

a heavy bag comprising an outer cylindrical shell having an inner volume and defining a vertical central axis when suspended for use and a substantially uniform bag diameter along said vertical central axis;

a sensor support having a generally cylindrical surface defining a substantially uniform diameter and having an axis coextensive with said vertical central axis, said diameter of said sensor support being greater than zero and less than said bag diameter;

at least one acceleration sensor each mounted within said heavy bag on said sensor support cylindrical surface for generating signals representing movements of the sensors reflecting the number and magnitude of impacts or physical blows on said heavy bag;

a workout processor unit, a power supply for powering said workout processor unit, said inner volume of said heavy bag is filled with impact resilient stuffing surrounding said at least one acceleration sensor, said at least one acceleration sensor being in electrical communication with said workout processor unit and said power supply, said workout processor unit being programmed to analyze, track and store workout information over at least one data collection period or workout session to reflect the quantity and magnitude of said physical blows delivered by said user said heavy bag workout monitor system retaining said workout information delivered by said user during at least one workout session or data collection period, whereby a user can view workout results from a stored workout data collection period or session.

2. The heavy bag workout monitor system of claim 1, wherein a plurality of acceleration sensors are provided.

3. The heavy bag workout monitor system of claim 1, wherein said plurality of acceleration sensors are spaced from each other along said axis.

4. The heavy bag workout monitor system of claim 1, wherein said bag defines a plurality of striking zones along said axis, at least one acceleration sensor being arranged with each of said striking zones.

5. The heavy bag workout monitor system of claim 1, further comprising at least one LCD display screen for visually displaying output data and for inputting input data by the user.

6. The heavy bag workout monitor system of claim 1, wherein said heavy bag has a substantially uniform diameter D along said axis and said sensor support for supporting said at least one acceleration sensor has a substantially uniform diameter d along said axis, and wherein $d \approx 0.15D$.

7. The heavy bag workout monitor system of claim 1, wherein said heavy bag comprises a first target section and a second target zone, said first target section representing an opponent's head, and said second target zone representing said opponent's body.

8. The heavy bag workout monitor system of claim 7, wherein said heavy bag further comprises a third target zone, said first target section representing an opponent's head, said second target zone representing said opponent's body, and said third target zone representing said opponent's legs.

9. The heavy bag workout monitor system of claim 1, wherein said at least one acceleration sensor is arranged to relay information pertaining to a quantity and a magnitude of said physical blows to said workout processor unit.

10. The heavy bag workout monitor system of claim 1, wherein said workout processor unit comprises a wireless communication interface.

11. The heavy bag workout monitor system of claim 10, wherein said wireless communication interface comprises Bluetooth.

12. The heavy bag workout monitor system of claim 11, wherein said workout processor unit is in wireless communication with a mobile electronic device comprising a user interface.

13. The heavy bag workout monitor system of claim 12, wherein said mobile electronic device comprises a smart phone.

14. The heavy bang workout monitor system of claim 12, wherein said mobile electronic device comprises a tablet.

15. The heavy bag workout monitor system of claim 12, wherein said mobile electronic device comprises a computer.

16. The heavy bag workout monitor system of claim 1, further comprising a remote Internet database, said workout processor unit being selectively in data communication with said remote Internet database to store a plurality of user profiles and data collected for a plurality of users, whereby multiple users can compare workout results.

17. A method of monitoring a user workout on a heavy bag comprising the steps of:

suspending a heavy bag having an outer cylindrical shell having a substantially uniform diameter D along a central axis;

providing a sensor support having a generally cylindrical surface defining a substantially uniform diameter and having an axis coextensive with said vertical central axis, said diameter of said sensor support being greater than zero and less than said bag diameter;

arranging at least one acceleration sensor within said heavy bag on said sensor support cylindrical surface;

transferring data within said at least one acceleration sensor to a workout processor unit programmed to analyze, track and store workout information over at least one data collection period or workout session to reflect a quantity and magnitude of physical blows to said heavy bag in response to motions or movements of said heavy bag;

retaining workout information during at least one workout period; and providing for review of said workout information from at least one of the following mediums: display monitor, smart phone, tablet, computer and audio output device, whereby a user can determine workout results from a stored workout data collection period or session.

* * * * *